US008016333B2

(12) United States Patent
Brunner

(10) Patent No.: US 8,016,333 B2
(45) Date of Patent: Sep. 13, 2011

(54) LOAD HOOK ARRANGEMENT

(75) Inventor: Martin Brunner, Lauterbrunnen (CH)

(73) Assignee: Heli Hook AG, Lauterbrunnen (CH)

( * ) Notice: Subject to any disclaimer, the term of this patent is extended or adjusted under 35 U.S.C. 154(b) by 323 days.

(21) Appl. No.: 12/211,877

(22) Filed: Sep. 17, 2008

(65) Prior Publication Data

US 2009/0072562 A1 Mar. 19, 2009

(30) Foreign Application Priority Data

Sep. 17, 2007 (EP) ..... 07116576

(51) Int. Cl.
*B66C 1/36* (2006.01)

(52) U.S. Cl. ..... 294/82.31; 294/82.2; 294/82.33

(58) Field of Classification Search ..... 294/82.23, 294/88, 106, 82.31, 82.32, 82.33, 82.34, 294/82.2, 82.22

See application file for complete search history.

(56) References Cited

U.S. PATENT DOCUMENTS

| | | | | |
|---|---|---|---|---|
| 2,864,644 | A | 12/1958 | Marryatt | |
| 3,575,459 | A * | 4/1971 | Coblenz | 294/82.32 |
| 3,845,978 | A | 11/1974 | Huber | |
| 4,034,992 | A * | 7/1977 | Epstein | 294/82.33 |
| 4,149,746 | A * | 4/1979 | Androski | 294/82.3 |
| 4,174,132 | A * | 11/1979 | Crook, Jr. | 294/82.3 |
| 4,611,842 | A * | 9/1986 | Epstein | 294/82.33 |
| 2004/0056493 | A1 * | 3/2004 | Vanagan | 294/67.21 |
| 2005/0258658 | A1 | 11/2005 | Tollenaere | |

FOREIGN PATENT DOCUMENTS

JP 2004210518 A 7/2004

OTHER PUBLICATIONS

European Search Report from corresponding European application EP 07116576.

* cited by examiner

*Primary Examiner* — Paul T Chin
(74) *Attorney, Agent, or Firm* — WRB-IP LLP

(57) ABSTRACT

A load hook arrangement includes a carrying element for the load, which is pivotable between a dosed position and an open position, a first blocking element, which is pivotable between a blocking position for blocking the carrying element in its dosed position and a releasing position for allowing the carrying element to pivot into its open position, and a pivoting mechanism for pivoting the carrying element into its open position, wherein the load hook arrangement further includes a second blocking element, for blocking the carrying element in its closed position. This second blocking element can be in particular a magnet brake acting on the pivoting mechanism. Furthermore, the load hook arrangement can include a third blocking element for blocking the movement of the first blocking element. This third blocking element can be in particular an eccentric.

12 Claims, 7 Drawing Sheets

LOAD HOOK ARRANGEMENT

BACKGROUND AND SUMMARY

The present invention relates to a load hook arrangement, comprising a carrying element for a load, the carrying element being pivotable between a closed position and an open position. The present invention relates in particular to such a load hook arrangement as can be used for carrying a load by means of a helicopter or other similar aircraft.

Load hooks (also known as cargo hooks) are commonly used when loads are to be transported by means of helicopters and other similar aircraft. For this purpose a cable with a load hook arrangement on one of its ends is fastened to the helicopter which is equipped with a mechanical and/or an electrical release device for the load. Such load hook arrangements are very useful for transporting loads in mountain regions, for example, where no roads exist or where roads cannot be used for any reason (e.g. due to extreme weather conditions in winter). Use of load hook arrangements is thus very popular in logging. In addition, loads are often carried by means of helicopter aircraft for military purposes or in construction, where the load can be of any kind of material or even people. Finally, load hook arrangements are used for transporting casualties (e.g. people lost and injured in the mountains) or for carrying fire extinguishers in major forest fires.

A conventional load hook arrangement usually includes a carrying element (load beam) which can pivot between two positions. In its open position, one end of the carrying element is turned away from the housing of the load hook arrangement, and a load ring attached to a cable with the load can be placed on the carrying element. In its closed position, the end of the carrying element is located such that the attached load ring is blocked between the carrying element and the housing of the load hook arrangement. The load transported by means of helicopter and carried by load hook arrangements can weigh several tons, depending on the type of helicopter and the purpose of transport. It is thus clear that load hook arrangements have to be designed and constructed in such a way as to be able to carry a load with a high degree of safety, where in particular the carrying element is securely blocked in the closed position. Therefore, a conventional load hook arrangemen't also includes a blocking element which is used to block the carrying element in the closed position. This blocking element can usually switch between a blocking position, in which it maintains the carrying element in its closed position, and a releasing position, in which the carrying element is allowed to pivot from the closed position to the open position.

When a load is to be transported, the blocking element is brought into the releasing position in order to allow the carrying element to come into the open position, in which the load ring of the cable is attached to it. Then, the carrying element is brought into the closed position and blocked again by the blocking element. A spring (or another similar mechanical element) is responsible for the constant correct positioning of the blocking element in the conventional load hook arrangements. This spring holds the blocking element by default in the blocking position, unless an exterior force is applied. In such a way, the pivoting of the carrying element from its closed position to its open position always requires a deliberate action of an operator, which increases the security of the load hook arrangement significantly.

However, a load attached to a cable usually does not remain stable under the helicopter during transport, but normally oscillates and rotates on the supporting cable. This can give rise to severe safety problems, as the one end of the cable can come into a position where it exerts pressure on the blocking element. In such a situation, as a result of very high forces, the blocking element can easily be brought into the releasing position. As the carrying element is then no longer held in its closed position, it pivots into the open position due to gravity and the supported load weight, and the carried load can simply fall off. Such disasters have occurred, where the price to pay was either serious material damage or loss of human life.

A prior art arrangement is described in United States patent document U.S. Pat. No. 3,845,978 (Huber), which discloses a load hook with a carrying element latched into place by a swivelling latch element, and a first locking element which prevents the latch element from opening accidentally and thereby releasing the load hook. In U.S. Pat. No. 3,845,978, the first locking element is remotely operated by means of a motor described as an electrical solenoid bell crank. The arrangement of U.S. Pat. No. 3,845,978 also includes a second blocking element—an override pin which an operator can manually insert into a hole in the mechanism to manually block the release mechanisms and thereby prevent accidental release of the load by the helicopter pilot or due to sudden rotation of the load hook caused by, for example, turbulence or impact.

However, the manual override pin arrangement of the load hook of U.S. Pat. No. 3,845,978 means that, once the override pin is inserted, the helicopter pilot no longer has the ability to release the load. It is important for the pilot to be able to release the load if for example, the helicopter encounters flight problems, or if the load itself endangers the helicopter by becoming unstable, or by becoming entangled in an obstacle or by catching fire. It is also important for the pilot to be able to release the load, without landing, at a site where no ground staff are present to assist with disconnecting the load from the load hook.

It is desirable to propose a new and improved load hook arrangement that does not have the above-mentioned drawbacks of the state of the art. In particular, it is desirable to propose a new load hook arrangement, in which the carrying element (load beam) can be secured such that the load can be safely carried in any situation.

According to an aspect of the present invention, a load hook arrangement comprises carrying element for carrying a load, the carrying element being pivotable between a closed position and an open position a pivoting mechanism for blocking or allowing the pivoting of the carrying element into its open position, the pivoting mechanism comprising a first blocking mechanism, the first blocking mechanism being pivotable between a blocking position for blocking the carrying element in its closed position and a releasing position for allowing the carrying element to pivot into its open position, a rotating arm element for blocking or allowing, under remote control of an operator, the first blocking element to pivot to its releasing position, a motor element for actuating the rotating arm element, and a second blocking element for blocking movement of the motor element, the second blocking element being remotely controllable by an operator.

The advantage of such a load hook arrangement is, among others, that the carrying element (i.e. the load beam), when carrying the load, is doubly secured in its closed position by the second blocking element in that it prevents the rotation of the motor element.

In an embodiment variant, the second blocking element acts on motor element which controls the rotating arm, whereby the second blocking element in its blocking position blocks the rotation of the motor element, which blocks the rotating arm, which blocks the carrying element. This embodiment variant has the particular advantage, among others, that the second blocking element does not act directly on the carrying element, but on the rotating arm which controls the pivoting of the carrying element. In this way, the first and second blocking elements use different blocking techniques in order to safely block the carrying element in its closed position. Owing to these different blocking techniques, the probability of a simultaneous failure of both blocking elements can be kept very small.

In another embodiment variant, the second blocking element is remotely controllable by an operator by means of a first control mechanism. The advantage of such an embodiment variant is, among other things, that the operator (i.e. the pilot from the cockpit of the helicopter or a person on the ground in charge of the correct positioning and attachment of the load) is able to control the functioning of the second blocking element remotely. The pilot might have a button which would allow him to control the second blocking element. In such a way, the pilot would not depend on any ground staff, and could check the correct position and blocking of the carrying element before starting the aircraft. On the other hand, the first control mechanism could also be activated by a person on the ground by means of another button or similar activating means, which could be useful when a double check is required.

In a further embodiment, the second blocking element is a magnet brake. The advantage of this embodiment is, among others, that the blocking of the carrying element can be achieved in a very simple way, but guaranteeing a high degree of safety at all times. Magnet brakes are known in the art as being simple to use and maintain, but having a very small degree of failure. The use of electrically controllable magnet brakes to impede rotational movement is known in other technical fields such as in automobiles—see for example U.S. Pat. No. 5,543,672 (Nishitani).

In particular, this magnet brake can be achieved in such a way as to automatically prevent the rotating arm from pivoting, and thereby prevent the release of the carrying element as long as an external releasing is not applied to the magnet brake. It makes use of brake discs, for example, or similar elements based on magnetic forces between the pivoting mechanism and the brake discs. In such a way, a blocking effect is automatically achieved, and it is only when the pivoting mechanism for pivoting the carrying element is to be activated that the blocking is released by means of the first control mechanism. Again, safety during load transport can thus be increased significantly.

In another embodiment of the present invention, the load hook arrangement further comprises a latch element pivotable between an open position, in which a load can be removed from the load hook, and a third blocking element for blocking the latch element in its closed position. The advantages of this embodiment is, inter glia, that the latch element can be secured by a third blocking mechanism, thus improving even more the safety of the load hook arrangement according to this embodiment of the present invention. In particular, the latch element can be achieved as a toggle which can pivot between a position in which the load ring cannot be released and a position in which the load ring can be removed freely. This latch element can, for example, be kept in the blocking position by means of a spring or another similar device. In order to move this toggle against the force of the spring, an exterior force is required, which can be supplied by means of an actuator (i.e. a cable). It is also conceivable to have this latch element blocked for any movement in a particular direction (i.e. by a stopper integrated in the housing) and allow the movement only in the opposite direction. In such a constellation, the latch element could also be brought into the releasing position by the load ring during its insertion onto the load. The third blocking element can in such a situation completely block the movement which would lead to a release of the load ring.

In a further embodiment, the third blocking element is able to be actuated by means of an actuating mechanism. The advantage of this embodiment is, among others, that the blocking of the latch element (toggle) can be controlled through actuation of the third blocking element. There is also a further increase in the safety of the load hook arrangement, as the possibility of pivoting of the carrying element from the closed position into the open position is further reduced.

In another embodiment, the actuating of the third blocking element is remotely controllable by an operator by means of a second control mechanism. The advantage of this embodiment of the present invention is, inter alia, that also the functioning of the third blocking element can be controlled remotely by an operator (i.e. the pilot from the cockpit of the helicopter or a person on the ground in charge of the correct positioning and attachment of the load). The pilot might have another button which would allow him to control both the second and the third blocking elements for checking the correct position and blocking of the carrying element before starting the aircraft.

In a further embodiment, the actuating mechanism comprises a weight sensor for detecting the presence of the load, by means of which sensor the actuating mechanism is controllable. This embodiment has the advantage, among other things, that the actuating mechanism for actuation of the third blocking element can be controlled in a fully automated way. In particular, the weight sensor can detect the presence of the attached load and initiate by itself the actuating of the actuating mechanism which consequently moves the third blocking element into the blocking position. Once the load is on the ground, i.e. once the weight sensor detects the absence of the corresponding gravitational force acting on the carrying element, it makes the actuating mechanism move the third blocking element into the releasing position, whereby movement of the latch element is again made possible. In such a way, not only is the safety of the load hook arrangement once again increased significantly, but its handling is drastically simplified.

In yet another embodiment, the third blocking element is an eccentric. The advantage of this embodiment is, among others, that the latch element can be blocked in its blocking position by means of a simple mechanical device. The actuating mechanism pivots the eccentric such that it changes its position relative to the latch element. In such a way, the movement of the latch element (toggle) is made completely impossible, so that an accidental release of the load attached to the load hook arrangement due to a pivoting of the latch element into its releasing position is completely impeded. With use of an eccentric as a third blocking element, its position then impedes completely any movement of the latch element out of its blocking position, such that no release of the load ring is possible. Of course, this again increases the overall safety of the load hook arrangement according to this embodiment of the present invention.

In still another embodiment, the load hook arrangement comprises an emergency release mechanism. The advantage of this embodiment is, among other things, that the carrying element can be brought quickly into the open position if an emergency situation should arise. In this situation, the pilot of the helicopter or any other person could release the attached load in order to prevent crash of the aircraft or injury to people on the ground. Such an emergency release mechanism could be based on mechanical, electrical, hydraulic or other elements, which allow release of all the different blocking elements and thus enable the pivoting of the carrying element into the open position for releasing the attached load.

BRIEF DESCRIPTION OF DRAWINGS

The present invention will be explained in more detail, by way of example, with reference to the drawings in which.

DESCRIPTION OF SPECIFIC EMBODIMENTS OF THE INVENTION

Figure 1:
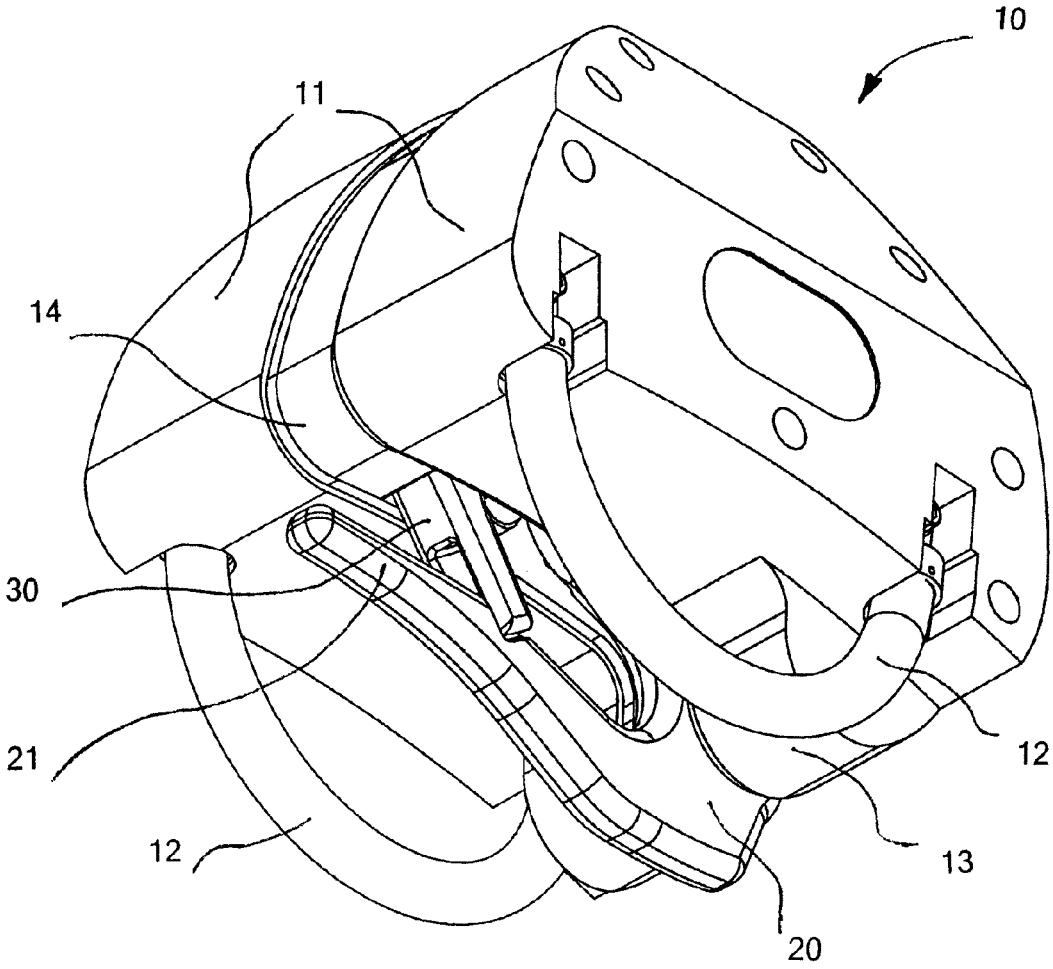
FIG. 1 is a schematic representation in perspective of a load hook arrangement according to one embodiment of the present invention with protective cover.

FIG. 1 illustrates a load hook arrangement 10 according to one embodiment of the present invention in a schematic, perspective representation. The reference numeral 11 in FIG. 1 relates to the protective cover of the load hook arrangement 10. This protective cover 11 comprises usually two symmetrical halves, and is made of a solid material, such as steel, or any other appropriate material. Its main purpose is to protect the different elements of the load hook arrangement 10 from dust or dirt or prevent damage from mechanical impacts. The reference numerals 12 in FIG. 1 refer to bars attached to the protective cover 11 which can be used as handles for operating the load hook arrangement 10 when on the ground. In particular, the bars 12 can be used for fixing the load hook arrangement 10 during the attachment of the load ring (not represented) to the carrying element 20 of the load hook arrangement 10. The reference numeral 14 in FIG. 1 refers to the housing of the load hook arrangement 10, which surrounds the different elements of the load hook arrangement 10. The carrying element 20, i.e. the load beam, is pivotable relative to the housing 14 of the load hook arrangement 10, around a first pivot point 13. In particular, the carrying element 20 can pivot between an open position (the tip 21 of the carrying element 20 having been moved away from the housing 14), and a closed position (the tip 21 of the carrying element 20 close to the housing 14), represented in FIG. 1. The pivoting of this carrying element 20 between the open and the closed position can in particular be controlled by means of a pivoting mechanism inside the housing 14, which will be described in more detail with reference to the following figures.

The reference numeral 30 in FIG. 1 refers to a latch element. This latch element 30 in FIG. 1 takes the form of a toggle. However, it is evident to a person skilled in the art that the latch element 30 could be designed in another way, without departing from the idea and the scope of the original invention. The latch element 30 is itself pivotable between a blocking position (as represented in FIG. 1) and a releasing position. The latch element 30 in its blocking position impedes the load (not represented) from falling off the carrying element 20, once the load hook arrangement 10 is in the air. For this purpose, the housing 14 of the load hook arrangement 10 and/or the carrying element 20 can comprise a stopper which blocks the movement of the latch element 30 in a particular direction. On the other hand, the movement of the latch element in the opposite direction (towards its releasing position) is possible only when applying an external force, such that the load ring with the attached load is safely positioned during transport.

Figure 2:
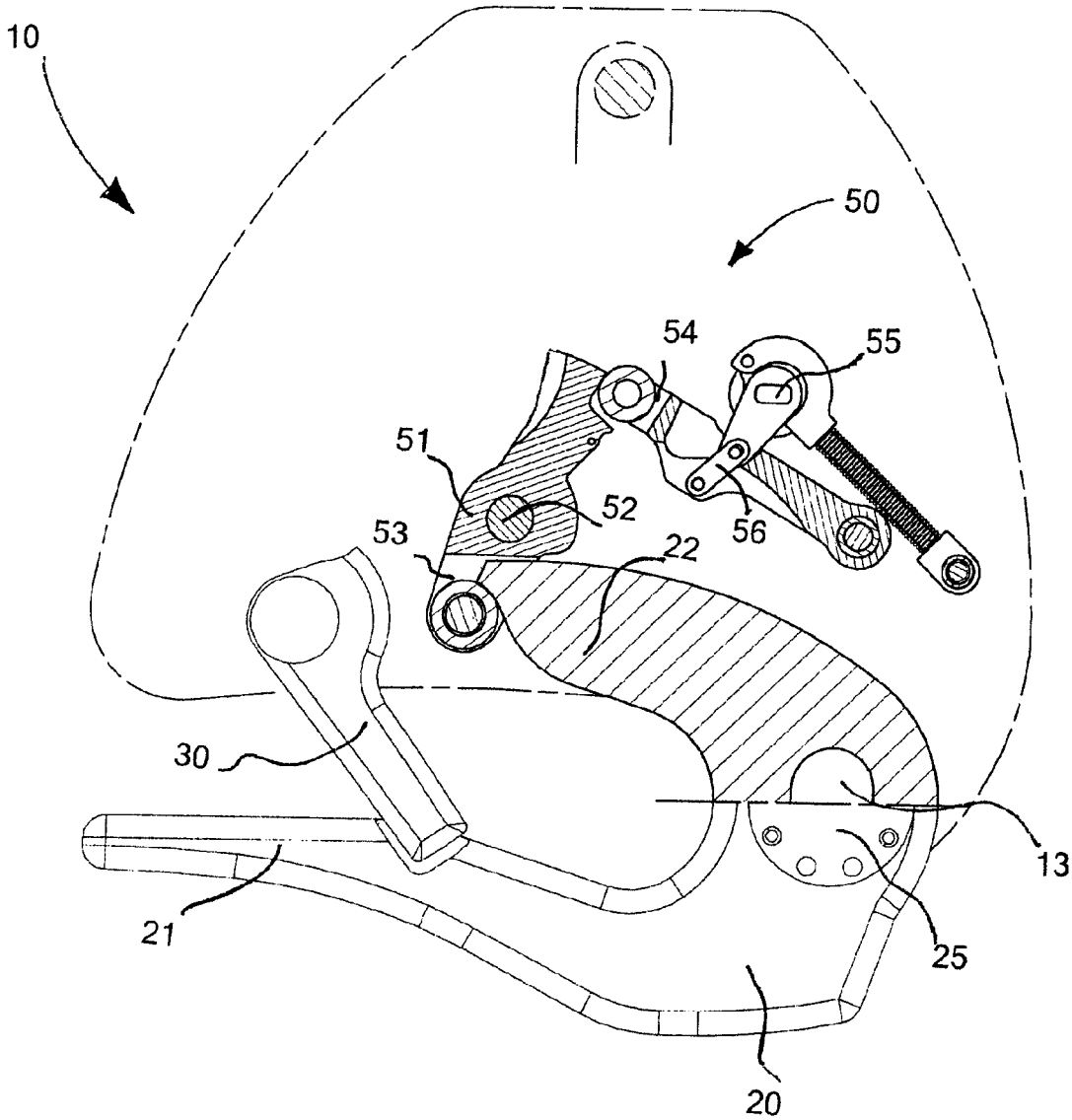
FIG. 2 is a sectional, schematic and simplified representation of a load hook arrangement according to one embodiment of the present invention, showing the carrying element is in its closed position.

FIG. 2 shows a sectional, schematic and simplified representation of a load hook arrangement 10 according to one embodiment of the present invention. The carrying element 20 is represented in its closed position. In this sense, FIG. 2 corresponds to the situation of the load hook arrangement 10 represented in FIG. 1. In FIG. 2 it can be seen that the carrying element 20 has basically the shape of the letter U. This U-shaped carrying element 20 can pivot around the pivot point 13. The exterior part of the carrying element 20 with the tip 21 carries the load ring during the load transport. On the other hand, the other side of the U, the interior part 22 of the carrying element 20, is engaged with the pivoting mechanism 50. The pivoting mechanism 50 comprises various elements which act jointly in order to block or allow the carrying element to pivot around the pivot point 13.

In the closed and secured position of the carrying element 20, as represented in FIG. 2, the interior part 22 of the carrying element 20 is engaged with a swivel lever 51 forming a first blocking element which can pivot around the pivot point 52. This swivel lever 51 comprises a recess 53 for engaging the interior part 22 of the carrying element 20. In FIG. 2, the interior part 22 of the carrying element 20 is engaged with the swivel lever 51 such that no movement of the carrying element around the pivot point 13 is possible. The pivoting of the swivel lever 51 around the pivot point 52 is made impossible by the rotating arm 54 which can be moved up and down by means of the motor 55 and a short connection lever 56. In such a position, the swivel lever 51 and the rotating arm 54 are capable of supporting the gravitational force of the carrying element 20 and the attached load such that the whole pivoting mechanism 50 stays immobile. The operation of the rotating arm 54 and other elements of the pivoting mechanism 50 will be explained in detail with reference to the following figures.

Figure 3:
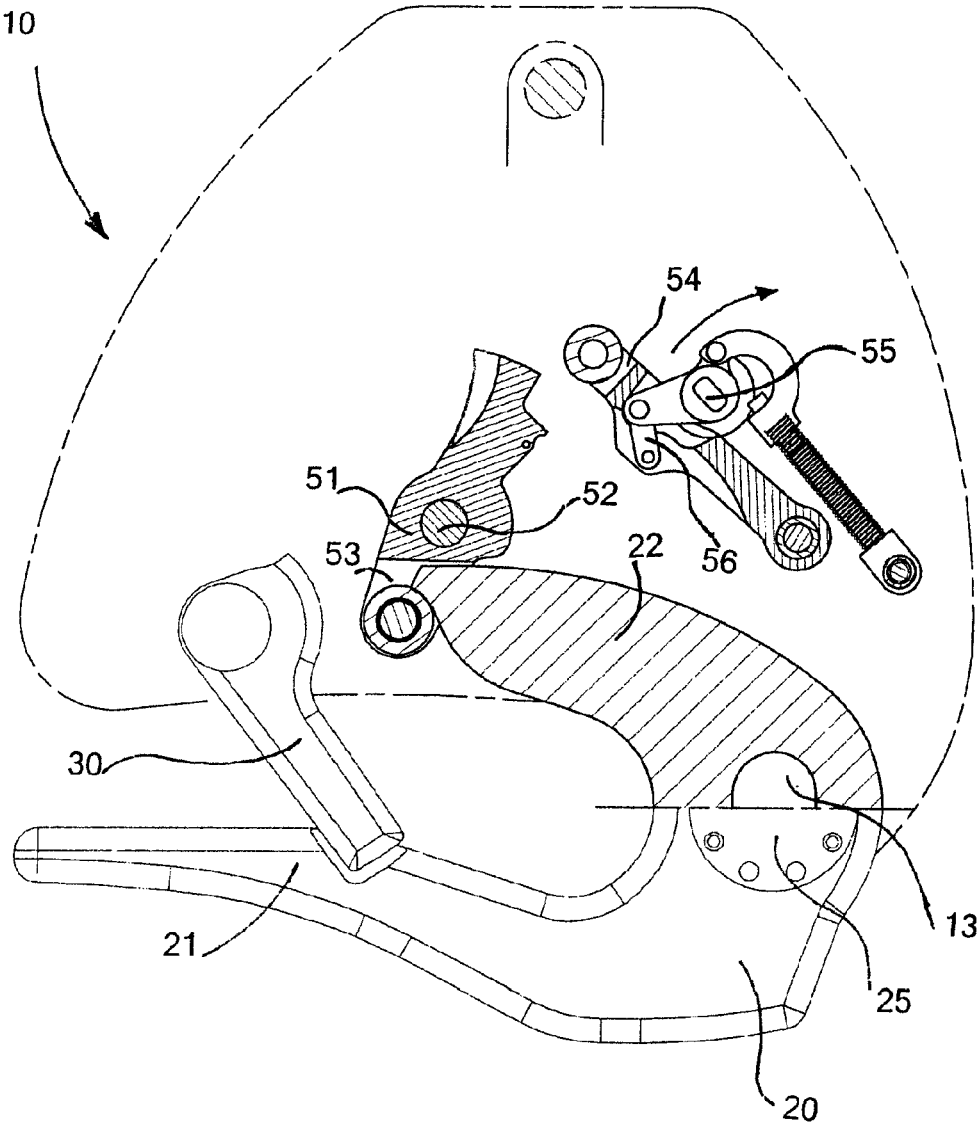
FIG. 3 is a sectional, schematic and simplified representation of a load hook arrangement according to one embodiment of the present invention, in which the carrying element is in its closed position, while the pivoting mechanism is being moved to pivot the carrying element to the open position.
Figure 4:
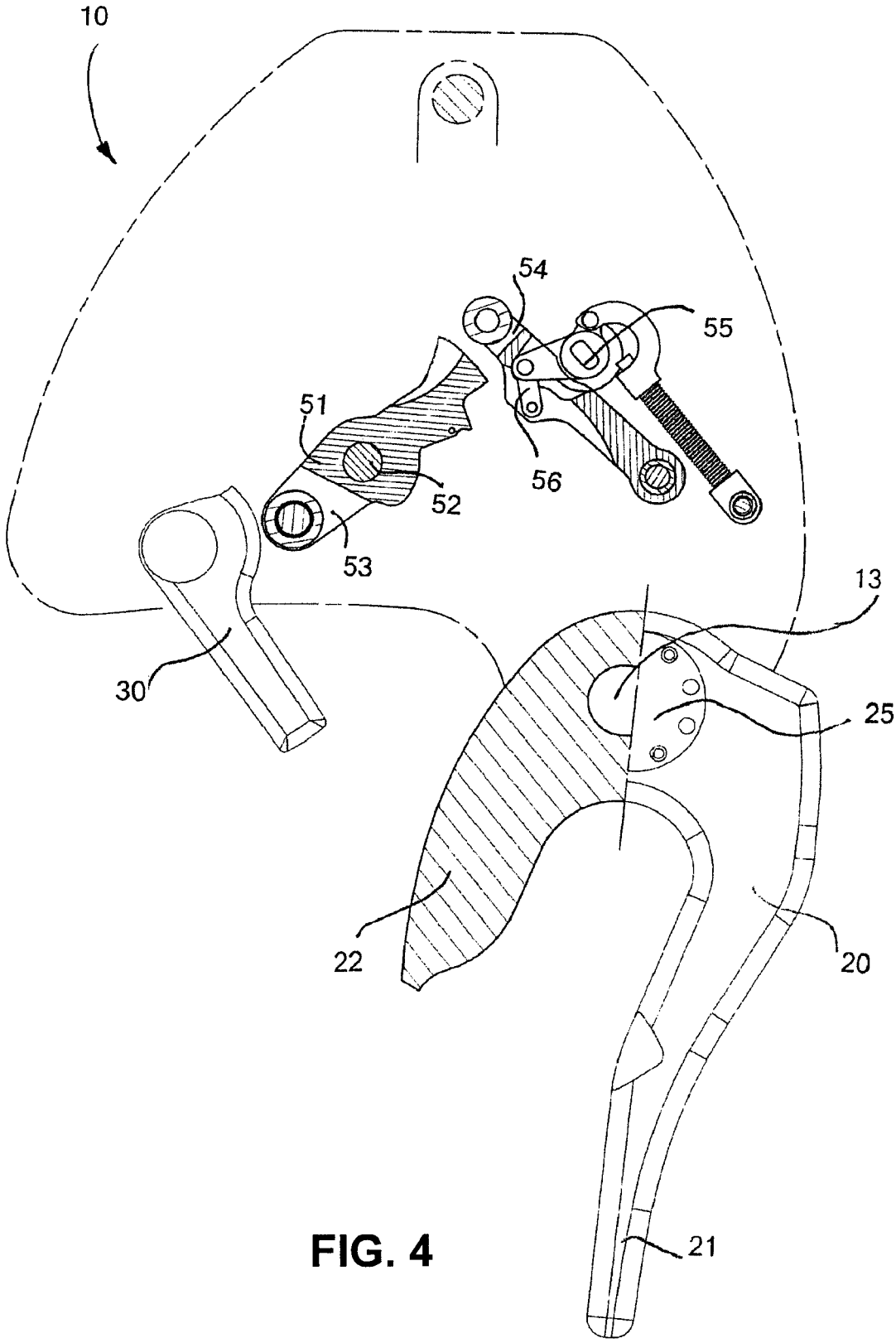
FIG. 4 is a sectional, schematic and simplified representation of a load hook arrangement according to one embodiment of the present invention, showing the carrying element is in its open position.

FIG. 3 represents the load hook arrangement 10 of FIG. 2, whereby the pivoting mechanism 50 is being moved into a position allowing the carrying element 20 to move from its closed position (as represented) into the open position (as will be represented in FIG. 4). All elements explained in detail with reference to previous figures have the same reference numerals and same functionalities, and their description is thus omitted here for the sake of greater simplicity and better understanding.

In FIG. 3, the motor 55 has been switched on, and it moves in the direction represented by an arrow. The movement of the motor 55 has been followed by the movement of the connection lever 56 such that the rotating arm 54 is pulled into the position where no connection exists between the rotating arm 54 and the swivel lever 51. The switching on of the motor 55 can basically be controlled remotely by the pilot of the aircraft. In such a position, the swivel lever 51 is no longer capable of supporting the gravitational force of the carrying element 20 and the attached load, and thus it is pivoted around the pivot point 52 which allows the interior part 22 of the carrying element 20 to disengage from the recess 53 of the swivel lever 51. Finally, the carrying element 20 can pivot around the pivot point 13 towards its open position (as represented in FIG. 4).

FIG. 4 shows a sectional, schematic and simplified representation of a load hook arrangement 10 of FIGS. 2 and 3. In FIG. 4, the carrying element 20 is in its open position, while the swivel lever 51 has pivoted around the pivot point 52. A support element (not represented) holds the swivel lever 51 in this position, where it is open for another engagement with the interior part 22 of the carrying element 20. In this position, the attached load ring can slip down from the exterior part 21 of the carrying element 20. Still in this position, a new load ring can be attached to the carrying element 20 for a new transport. Otherwise, the carrying element 20 can comprise a return spring 25 which pushes the carrying element 20 automatically into its closed position, once the load ring has been removed from it. This return spring 25 is in particular very useful for automatic discharge of loads, when the pilot uses the pivoting mechanism 50 to remotely bring the carrying element 20 into the open position at the destination where no staff is on the ground. Either way, the carrying element 20 returns into its closed position, and engages again with the swivel lever 51, whereby all the other elements of the pivotal mechanism 50 also regain their positions as in FIG. 2.

The pivoting mechanism 50 in FIGS. 2, 3 and 4 is equipped with a second blocking element 40, which serves to block the carrying element 20 in its closed position. In particular, this second blocking element 40 can be achieved as a magnet brake which acts on the motor 55. In this particular case, the magnet brake is designed such that, when the motor 55 is not energised, any movement of the motor 55 is made impossible, even when an exterior force is applied to it. For example, brake discs (not represented) can be equipped with springs or similar devices which push them automatically into the braking position. It is only after an exterior force is applied that the brake discs are removed from the braking position, enabling movement of the motor 55. In such a way, no accidental opening of the carrying element 20 is possible, as any movement is strictly impeded by the magnet brake 40. This second blocking element 40 increases therefore dramatically the safety of the load hook according to the present invention compared with conventional load hook arrangements.

Figure 5:
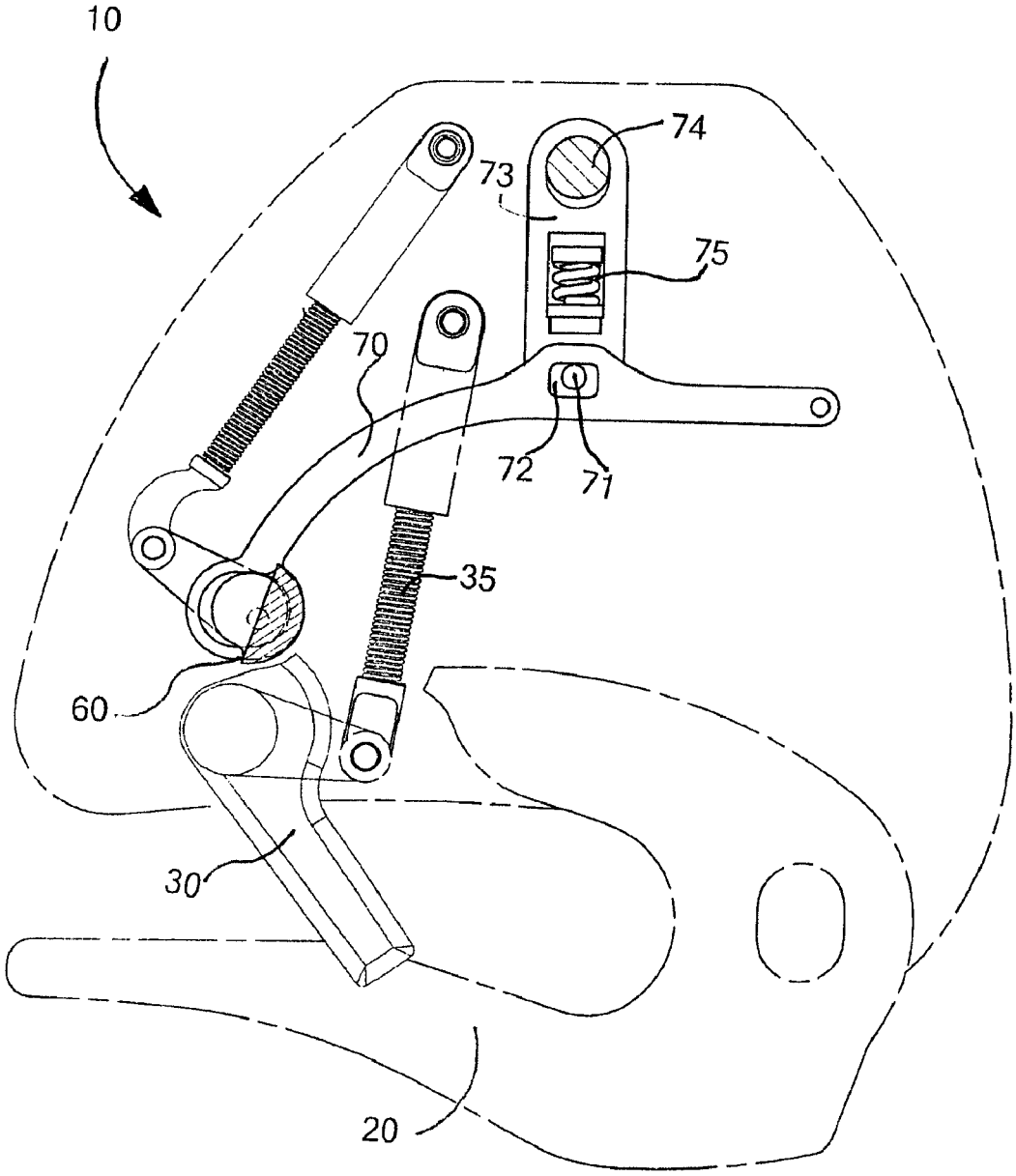
FIG. 5 is a sectional, schematic and simplified representation of a load hook arrangement according to one embodiment of the present invention, in which the third blocking element is in its blocking position, such that the latch element is locked in its blocking position.
Figure 6:
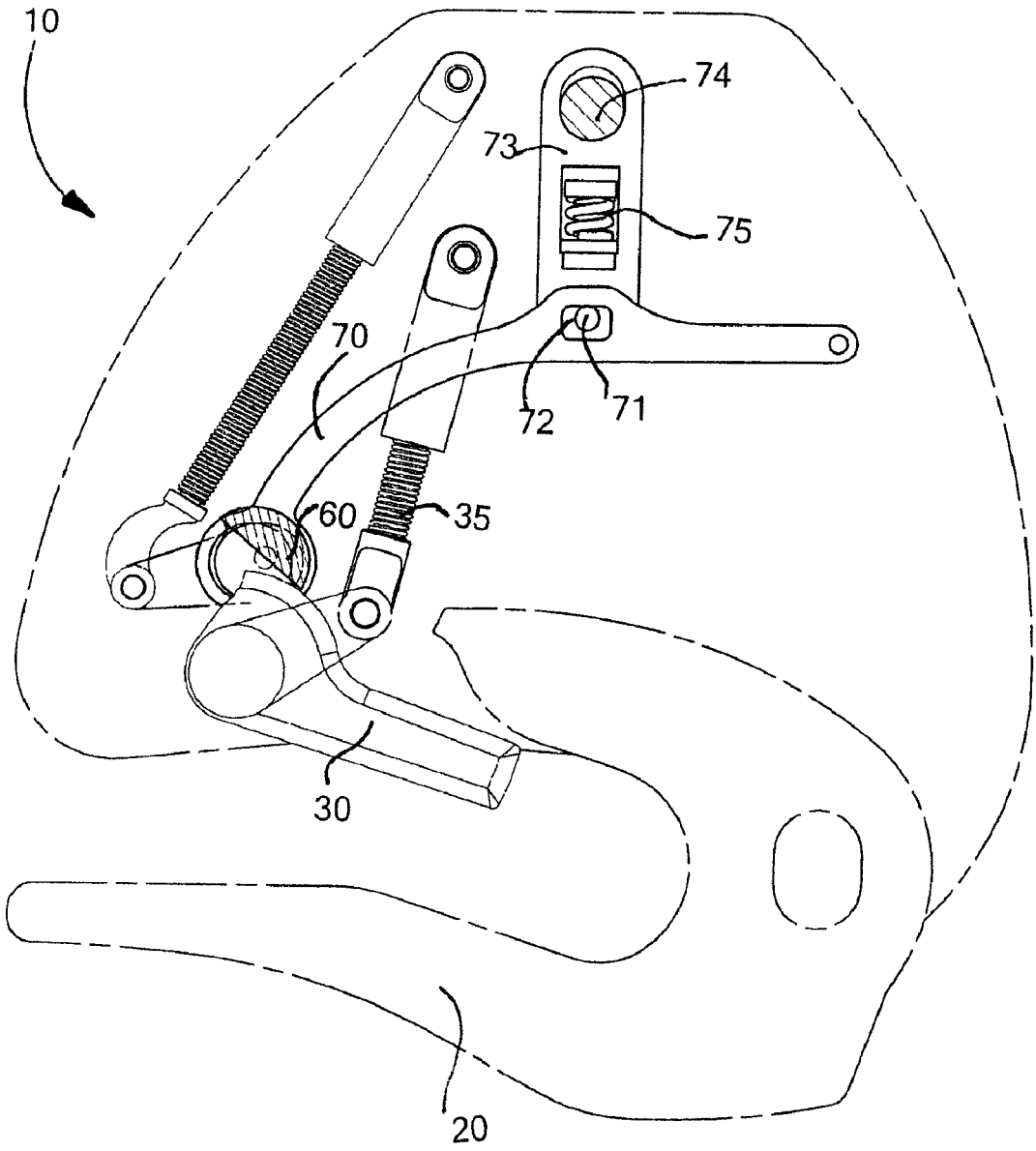
FIG. 6 is a sectional, schematic and simplified representation of a load hook arrangement according to one embodiment of the present invention, in which the third blocking element is in its releasing position, such that the latch element is moved into its releasing position.

However, the load hook arrangement 10 according to certain embodiments of the present invention offers an even higher degree of safety. FIG. 5 illustrates in a schematic and simplified way a load hook arrangement 10 according to another embodiment of the present invention. The load hook arrangement of FIG. 5 comprises a third blocking element 60 which is in its blocking position, which locks the latch element 30 in its blocking position. The latch element 30 does impede the load ring from slipping off the carrying element 20, once the carrying element 20 is in its closed position. In particular, a holding spring 35 or another similar element can be used in order to keep the latch element 30 safely in the blocking position (as represented), such that an exterior force has to be applied to the latch element 30 in order to bring it into its releasing position (as represented in FIG. 6). The third blocking element 60 now blocks the movement of the latch element 30, thus impeding completely any accidental release of the load ring and the attached load.

The third blocking element 60 in FIG. 5 is an eccentric. It is however obvious for any person skilled in the art that this example is not limiting, and that other similar or different modes of realisation of this third blocking means 60 exist. The eccentric 60 can be actuated by means of an actuating mechanism 70. This actuating mechanism 70 in the present example of FIG. 5 is a lever which can be moved by means of a bar 71. In fact, the lever 70 has a window 72 in which bar 71 is placed. The bar 71 itself is connected to a body 73 which can move up and down, being stopped in this movement by means of a stopper 74. In the resting position (as represented in FIG. 5), the bar 71 does not exert any force on the lever 70, and the eccentric 60 is situated in its blocking position, where no movement of the latch element 30 is allowed. However, each upward movement of the body 73 moves the bar 71, which pulls the actuating lever 70. As the actuating lever 70 is connected to the eccentric 60, the eccentric is moved into its releasing position which makes possible a switch of the latch element 30 into its releasing position (as represented in FIG. 6).

The load hook arrangement 10 according to this embodiment of the present invention can comprise a second control mechanism (not represented) for remotely controlling the actuating mechanism 70 by an operator. In particular, the operator can use this second control mechanism to move the body 73 and the connected bar 71 in the upwards direction, which results in the movement of the third blocking element 60. Otherwise, the actuating mechanism 70 can also comprise a weight sensor 75 (as in FIGS. 5 and 6) for detecting the presence of the load, whereby this weight sensor can control the actuating mechanism 70. In the present example (which is obviously not limiting whatsoever for any person skilled in the art), the weight sensor 75 is achieved with the aid of a spring which is indirectly connected to the carrying element 20 and which can register the presence or the absence of the load attached to the carrying element, owing to the gravitational force. This gravitational force results in a movement of the body 73 and the corresponding bar 71 downward, which results automatically in a movement of the actuating lever 70 and the switching of the second blocking mechanism 60 (eccentric) into the blocking position. Thus, the securing of the latch element 30 in its blocking position may be achieved fully automatically, without any external operator.

Figure 7:
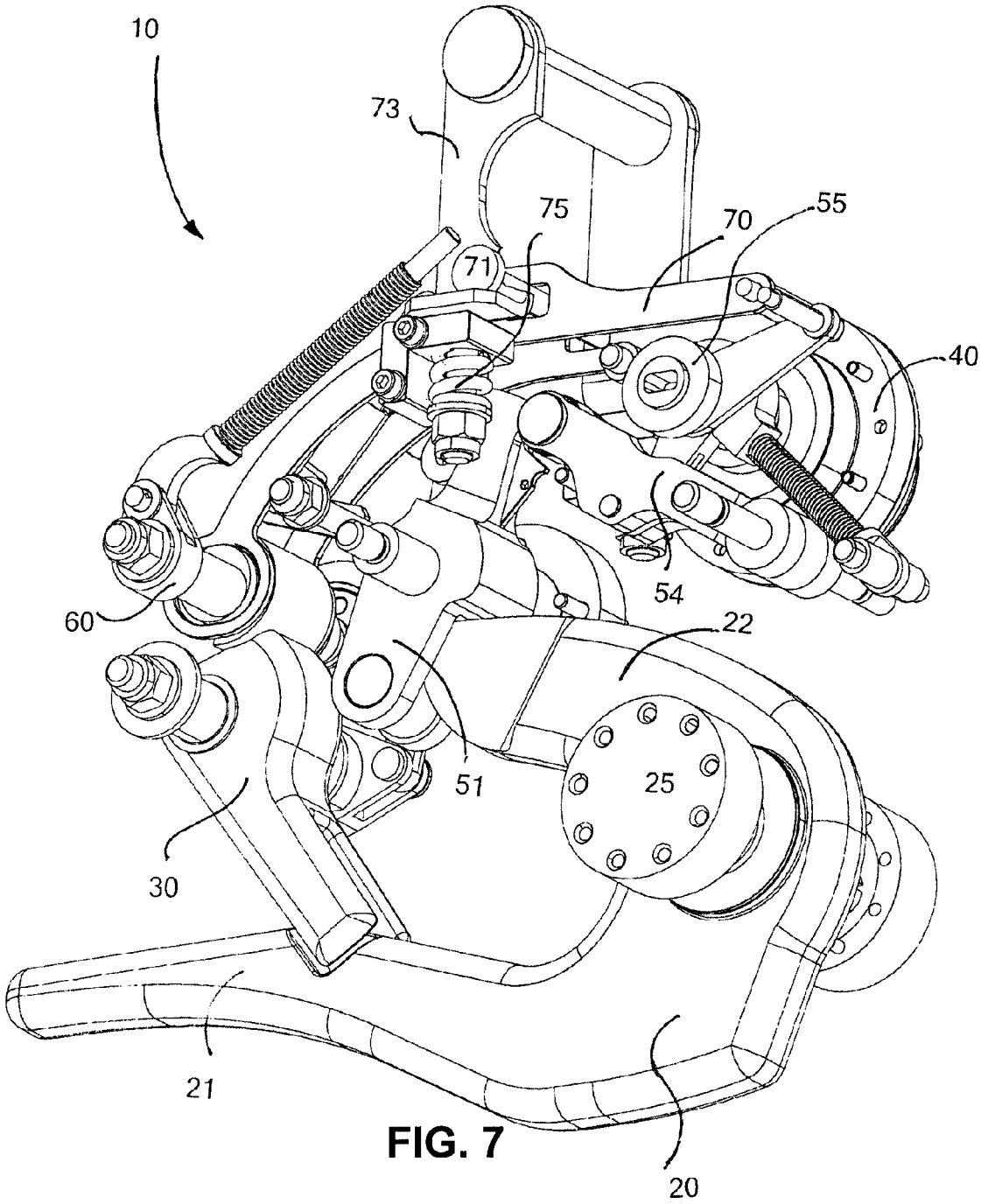
FIG. 7 is a simplified, schematic representation in perspective of a load hook arrangement according to one embodiment of the present invention without the protective cover.

FIG. 7 shows once again a simplified, schematic representation in perspective of a load hook arrangement 10 according to one embodiment of the present invention, without the protective cover. All elements have already been described in the foregoing, and a repetition of the description is therefore omitted here.

It is to be said that the load hook arrangement 10 according to the embodiments of the present invention is a load hook arrangement 10 of high precision with very high safety standards. The two potentially unsafe elements (the carrying element 20 and the latch element 30) are safely secured and blocked in their closed positions, where no accidental release of the load is possible. This load hook arrangement 10 is thus suitable for use in many different situations, without risk of human lives or material damage from dropping the load.

Although the present disclosure has been described with reference to particular means, materials and embodiments, one skilled in the art can easily ascertain from the foregoing description the essential characteristics of the present disclosure, while various changes and modifications may be made to adapt the various uses and characteristics without departing from the spirit and scope of the present invention as set forth in the following claims.

The invention claimed is:

1. A load hook arrangement, comprising a carrying element for carrying a load, the carrying element being pivotable between a closed position and an open position, and a pivoting mechanism for blocking or allowing the pivoting of the carrying element into its open position, the pivoting mechanism comprising a first blocking mechanism, the first blocking mechanism being pivotable between a blocking position for blocking the carrying element in its closed position and a releasing position for allowing the carrying element to pivot into its open position, a rotating arm element for blocking or allowing, under remote control of an operator, the first blocking element to pivot to its releasing position, a motor element for actuating the rotating arm element, and a second blocking element for blocking movement of the motor element, the second blocking element being remotely controllable by an operator.

2. The load hook arrangement according to claim 1, in which the second blocking element is a magnet brake.

3. The load hook arrangement according to claim 1, in which the second blocking element includes brake discs equipped with spring elements for pushing the brake discs automatically into a braking position, thereby blocking movement of the motor element.

4. The load hook arrangement according to claim 3, wherein the third blocking element is an eccentric.

5. The load hook arrangement according to claim 1, in which the load hook arrangement further comprises latch element pivotable between an open position, in which a load can be removed from the carrying element and a closed position, in which the load is blocked from falling off the carrying element, and a third blocking element for blocking the latch element in its closed position.

6. The load hook arrangement according to claim 5, wherein the third blocking element is able to be actuated by an actuating mechanism.

7. The load hook arrangement according to claim 6, wherein the actuating mechanism comprises a weight sensor for detecting the presence of the load, by which sensor the actuating mechanism is controllable.

8. The load hook arrangement according to claim 5, in which the second blocking element is a magnet brake.

9. The load hook arrangement according to claim 1, wherein the load hook arrangement comprises an emergency release mechanism.

10. The load hook arrangement according to claim 1, in which the second blocking element includes brake discs equipped with spring elements for pushing the brake discs automatically into a braking position, thereby blocking movement of the motor element.

11. The load hook arrangement according to claim 10, wherein the third blocking element is an eccentric.

12. A load hook arrangement, comprising a carrying element for carrying a load, the carrying element being pivotable between a closed position and an open position, and a pivoting mechanism for blocking or allowing the pivoting of the carrying element into its open position, the pivoting mechanism comprising a first blocking mechanism, the first blocking mechanism being pivotable between a blocking position for blocking the carrying element in its closed position and a releasing position for allowing the carrying element to pivot into its open position, a rotating arm element for blocking or allowing, under remote control of an operator, the first blocking element to pivot to its releasing position, a motor element for actuating the rotating arm element, a second blocking element for blocking movement of the motor element, and a latch element pivotable between an open position, in which a load can be removed from the carrying element and a closed position, in which the load is blocked from falling off the carrying element, and a third blocking element for blocking the latch element in its closed position, the third blocking element being actuatable by an actuating mechanism, wherein the actuating mechanism comprises a weight sensor for detecting the presence of the load, by which sensor the actuating mechanism is controllable.

* * * * *